US007281519B2

(12) United States Patent
Schroeder et al.

(10) Patent No.: US 7,281,519 B2
(45) Date of Patent: Oct. 16, 2007

(54) SET OF PISTON TYPE FUEL PUMPS FOR INTERNAL COMBUSTION ENGINES WITH DIRECT FUEL INJECTION

(75) Inventors: Bernd Schroeder, Esslingen (DE); Oliver Albrecht, Bietigheim-Bissingen (DE); Manuel Schoepke, Ceske Budejovice (CS); Helmut Rembold, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 128 days.

(21) Appl. No.: 10/556,078

(22) PCT Filed: Mar. 18, 2004

(86) PCT No.: PCT/DE2004/000550

§ 371 (c)(1),
(2), (4) Date: Nov. 9, 2005

(87) PCT Pub. No.: WO2004/104420

PCT Pub. Date: Dec. 2, 2004

(65) Prior Publication Data

US 2007/0020131 A1 Jan. 25, 2007

(30) Foreign Application Priority Data

May 20, 2003 (DE) ..... 103 22 604

(51) Int. Cl.
*F02M 37/04* (2006.01)
*F04B 1/04* (2006.01)
*F04B 1/12* (2006.01)

(52) U.S. Cl. ..... 123/445; 417/269; 417/273

(58) Field of Classification Search ..... None
See application file for complete search history.

(56) References Cited

U.S. PATENT DOCUMENTS

| | | | | |
|---|---|---|---|---|
| 5,035,221 | A * | 7/1991 | Martin | 123/451 |
| 5,634,777 | A * | 6/1997 | Albertin et al. | 417/273 |
| 5,765,512 | A * | 6/1998 | Fraser | 123/54.1 |
| 5,803,039 | A * | 9/1998 | Pien | 123/197.1 |
| 6,412,454 | B1 | 7/2002 | Green | |
| 6,814,548 | B2 * | 11/2004 | Sagnet | 417/273 |
| 2001/0042436 | A1 * | 11/2001 | Pierrat | 91/491 |
| 2004/0028532 | A1 | 2/2004 | Beyer et al. | |
| 2004/0136837 | A1 | 7/2004 | Ganser et al. | |

FOREIGN PATENT DOCUMENTS

| | | | |
|---|---|---|---|
| DE | 24 15 884 | A | 10/1975 |
| DE | 103 45 406 | A1 | 4/2004 |
| WO | WO 01/79695 | A1 | 10/2001 |

* cited by examiner

*Primary Examiner*—Thomas Moulis
(74) *Attorney, Agent, or Firm*—Ronald E. Greigg

(57) ABSTRACT

A plurality of piston pumps form a set of piston pumps, each including one drive region and at least one pumping region. The a set of piston pumps includes at least two piston pumps of different models, and the pumping regions of all the piston pumps the set are embodied as structurally identical pumping modules.

17 Claims, 8 Drawing Sheets

SET OF PISTON TYPE FUEL PUMPS FOR INTERNAL COMBUSTION ENGINES WITH DIRECT FUEL INJECTION

CROSS-REFERENCE TO RELATED APPLICATIONS

This application is a 35 USC 371 application of PCT/DE 2004/000550 filed on Mar. 18, 2004.

BACKGROUND OF THE INVENTION

1. Field of the Invention

The invention relates to a set of piston pumps, in particular fuel pumps for internal combustion engines with direct fuel injection, each having one drive region and at least one pumping region.

The subject of the invention is also a piston pump, in particular a fuel pump for internal combustion engines with direct fuel injection, having one drive region and at least one pumping region.

2. Description of the Prior Art

Piston pumps of the type with which this invention is concerned are known, for instance from German Patent Disclosure DE 199 07 311 A1 which discloses hydraulic pumps with a drive housing in which a drive shaft is supported. As a result, a drive region of the hydraulic pump is formed. A piston is located radially to the axis of the drive shaft and is received in a cylinder bush in a way capable of reciprocation. The reciprocation is forced on the piston by cams of the drive shaft. A cylinder head with an inlet valve and an outlet valve is secured to the drive housing. A piston, cylinder bush, cylinder head, inlet valve and outlet valve, and other components form a pumping region of the hydraulic pump, because in the final analysis it is through this region that the fuel is pumped. The known piston pump is a two-cylinder radial piston pump. This defines the design of the known piston pump.

It is the object of the invention to reduce the production costs of piston pumps and expand their range of application.

This object is attained, in a set of piston pumps of the type defined at the outset, in that the set of piston pumps includes at least two piston pumps of different design, and the pumping regions of all the piston pumps of the set are embodied as structurally identical pumping modules.

SUMMARY AND ADVANTAGES OF THE INVENTION

The term "structurally identical" is understood to mean a uniform construction of the pumping modules with identical coupling points for coupling to the drive region. By using such structurally identical pumping modules, the production costs can be reduced, since despite different designs, or models, of piston pumps, the same pumping modules can always be used and can therefore be mass-produced in great numbers. Moreover, the repair costs for such piston pumps are also reduced, since only one pumping module has to be kept on hand even for different models of piston pumps. Because the pumping regions are designed as pumping modules, the replacement of a defective pumping region is also made easier, since possibly only the pumping module rather than the entire piston pump will have to be replaced.

In a first refinement, it is proposed that the models in a set differ in the arrangement and/or number of the pumping modules. Despite structurally identical pumping modules, piston pumps can be created that are attuned very particularly to given requirements of use. Possible examples are one- and multi-cylinder radial, axial, and in-line piston pumps.

It is possible that the set of piston pumps includes structurally identical pumping modules and/or pumping modules that are mirror-reversed structurally identical to one another with respect to a longitudinal axis. If the pumping modules are identical to one another, the costs saving is maximal. However, if two types of structurally identical pumping modules are provided that are each mirror-reversed to one another, then the flexibility in arranging the pumping modules is increased.

A particularly preferred embodiment of the set of piston pumps according to the invention is distinguished in that the drive regions of the piston pumps of a set are embodied as structurally identical drive modules, which have a plurality of connection points for pumping modules, and the set includes at least one piston pump whose drive module has a connection point at which there is no pumping module and which is instead closed by a closure element. In this way, with the same drive module, different models of piston pumps can be made. In principle, in this embodiment of the invention, only two different components, namely drive modules and pumping modules, have to be produced for one set of piston pumps in order nevertheless to be able to manufacture completely different models of piston pumps within the set. With a structurally identical drive module, even piston pumps with different numbers of cylinders can be made, since the connection points in a drive module that are not occupied by a pumping module are simply closed.

In a refinement of this, it is proposed that the drive modules have a uniform connection to different securing devices, with which the piston pump can be fixed. As a result, a single type of drive module can be employed in very different installation situations.

It is also proposed that the set of piston pumps includes at least one piston pump having a pumping module which is inserted into the drive region. This makes assembly of the pumping module much easier.

This is particularly true whenever the set of piston pumps includes at least one piston pump whose drive region is integrated with an internal combustion engine. In that case, the at least one pumping module is secured directly to the engine or inserted into it. This has advantages above all whenever there is only little available space for installing the piston pump.

Greater variability and pumping capacity and also the pumping characteristics of the piston pumps of one set is possible, however, if the set of piston pumps includes at least one piston pump, whose drive region is separate from the engine.

Another embodiment of the set of piston pumps of the invention provides that for at least one piston pump, all the fluid connections are located outside the at least one pumping module. This makes for easier maintenance, above all, and simplifies the construction of the pumping modules.

A further preferred embodiment is distinguished in that the set of piston pumps includes at least one piston pump, whose drive region is coupled to a drive mechanism by means of a coupling device, and that in the region of the drive mechanism there is a device with which lubricant is injected into the drive region. In this way, a separate lubricant supply to the drive region of the piston pump can be dispensed with, which further reduces the production cost of the piston pump and simplifies its construction.

The refinement of the set of piston pumps in which there is at least one piston pump which has an overflow edge, by means of which the maximum height of a lubricant sump in the drive region is defined, is aimed in the same direction.

Since all the components pertaining to pumping are integrated with the pumping module, the drive region is largely kept free of high fluid pressure. Thus in the set of piston pumps according to the invention, only comparatively slight demands are made in terms of strength for the drive region. This makes it possible for the set of piston pumps to include at least one piston pump, whose drive region has a housing of lightweight metal. However, it is also possible that at least one piston pump is provided whose housing is produced as a forged or injection-molded part.

BRIEF DESCRIPTION OF THE DRAWINGS

Especially preferred exemplary embodiments of the present invention will be described in further detail below in conjunction with the accompanying drawings, in which.

DESCRIPTION OF THE PREFERRED EMBODIMENTS

Figure 1:
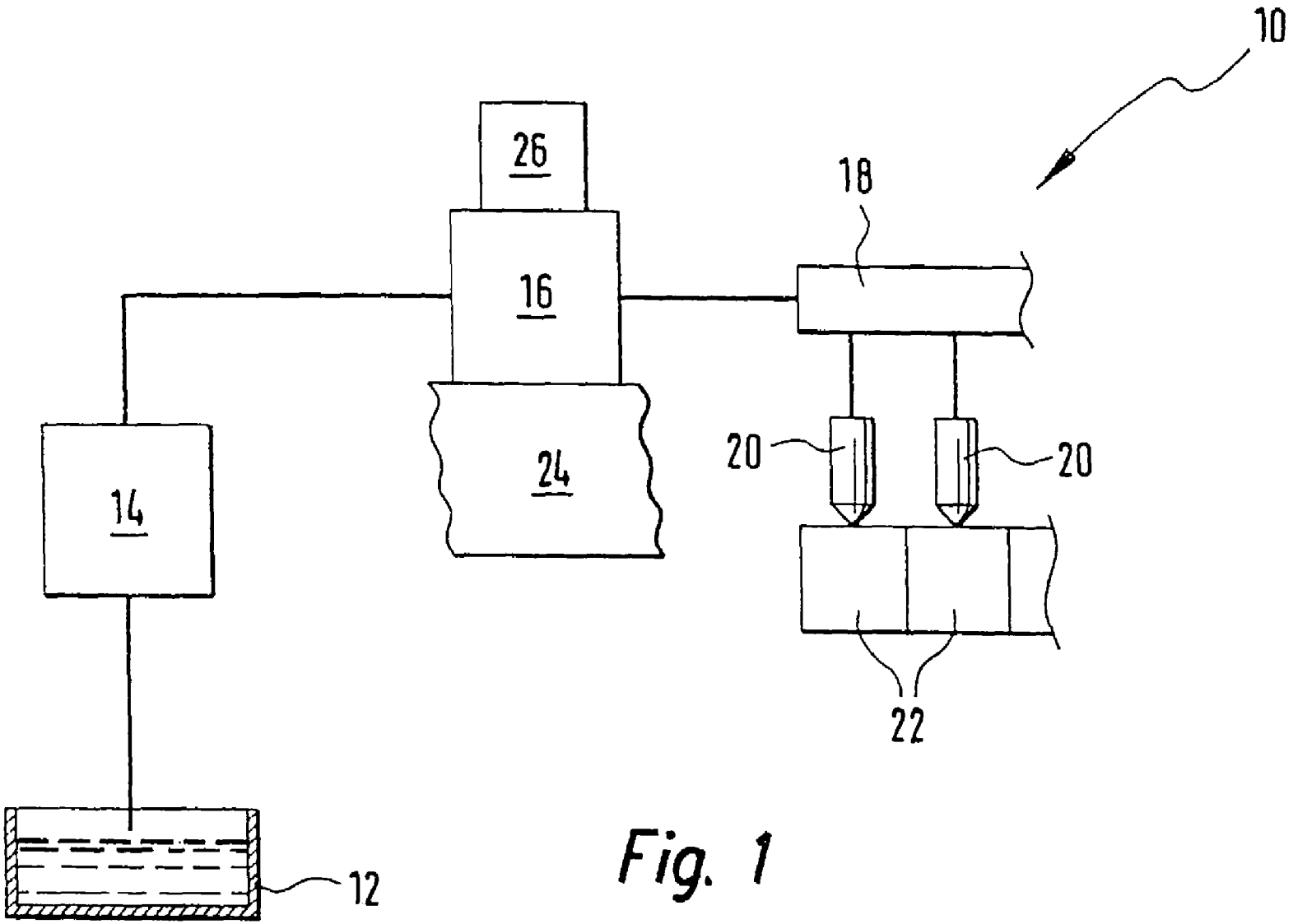
FIG. 1 is a schematically illustration of an internal combustion engine with a fuel system and a high-pressure piston pump.

An internal combustion engine in FIG. 1 is identified overall by reference numeral 10. It includes a fuel tank 12, from which a prefeed pump 14 pumps the fuel to a high-pressure piston pump 16. This pump pumps the fuel onward into a fuel collection line 18 ("rail"), in which the fuel is stored at high pressure. Connected to it are a plurality of fuel injection devices 20, which inject the fuel directly into combustion chambers 22 assigned to them.

The high-pressure piston pump 16 is secured to an engine block 24 of the engine 10. It is mechanically coupled, at least indirectly, to the crankshaft of the engine 10; that is, it is driven by the engine 10. The pumping quantity of the high-pressure fuel pump 16 is adjusted by a quantity control valve 26.

The high-pressure piston pump 16 can be realized in various models. A number of possible models can be found in the table in FIG. 2. A common feature of all the possible models is the fact that they have at least one pumping module 28 and one drive region 30. The precise construction of a pumping module and a drive region will be described in further detail hereinafter. At this point, it will merely be pointed out that the pumping module 28 includes all the components that compress and pump the fuel, such as a piston, while conversely the drive region 30 serves to drive the moving components of the pumping module 28.

Figure 2:
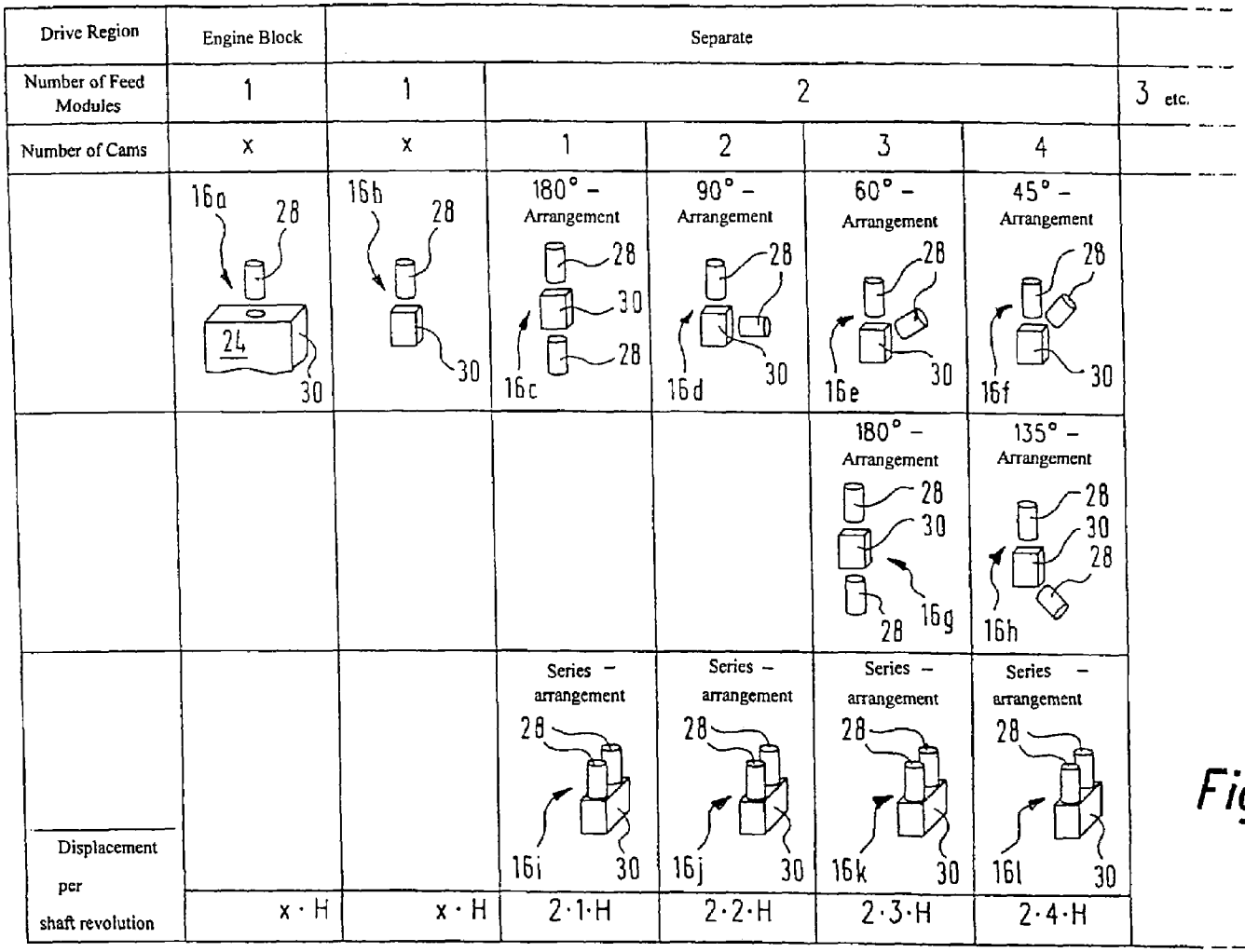
FIG. 2 is a table that shows possible models of the high-pressure piston pump of FIG. 1, in which all the models shown are part of one set of piston pumps with a structurally identical pumping module.

All the high-pressure piston pumps 16 shown in FIG. 2 are part of a set of high-pressure piston pumps 16 that is characterized, among other features, by structurally identical pumping modules 28. The differences among the various models of the set of high-pressure piston pumps 16 shown in FIG. 2 pertain to the attachment of the pumping modules 28, their number, their arrangement, and the precise embodiment of the drive region 30.

A first model of a high-pressure piston pump in FIG. 2 is identified by reference numeral 16*a*. In it, the pumping module 28 is inserted into the engine block 24 of the engine 10. In this case, the drive region 30 is accordingly integrated with the engine block 24. The drive of the moving components of the pumping module 28 is effected in this case by a camshaft (not visible in FIG. 2) that is present in the engine block 24. The pumping volume per revolution of the camshaft is equivalent to the number x of cams present on the camshaft, times a displacement H.

A further model of a high-pressure piston pump 16*b* has a drive region 30 that is separate from the engine block 24. It is embodied as a drive module, which has a plurality of connection points for securing and driving pumping modules 28. In this way, in "building block fashion", always with the same drive region 30 and a different arrangement or number of pumping modules 28, a high-pressure piston pump 16 that meets the specific requirements precisely can be created. In the case of the high-pressure piston pump 16*b*, only one pumping module 28 is provided on the drive module 30. The pumping volume of this high-pressure piston pump 16*b* is equivalent to the number x of cams of the camshaft present in the drive module 30, times the displacement H of the piston present in the pumping module 28.

A further model is identified in FIG. 2 by reference numeral 16*c*. It differs from the high-pressure piston pump 16*b* in that a further pumping module 28 in a 180° arrangement is provided, creating what is called a "boxer arrangement" of the pump cylinders. If the camshaft in the drive module 30 has only a single cam, then the pumping volume per revolution of the camshaft is equivalent to twice the displacement of the pistons of the pumping modules 28.

In a model 16*d* of a high-pressure piston pump, there are again two pumping modules 28, but they are located at a 90° angle to one another. When there are two cams on the camshaft, the pumping volume per camshaft revolution is twice as high as in the preceding model. The model 16*e* has two pumping modules 28, located at an angle of 60° to one another. When there are three cams on the camshaft, the result is a pumping volume per camshaft revolution that is equivalent to three times the pumping volume of the model 16*c*. Still another model having two pumping modules 28, located at an angle of 45° to one another, is identified by reference numeral 16*f*. For a camshaft with four cams, four times the pumping volume per camshaft revolution is achieved in comparison to model 16*c*.

A model 16*g* has two pumping modules 28 in the boxer arrangement. The drive region 30 used there, however, has a camshaft with three cams, so that in comparison to model 16*c*, three times the pumping volume per camshaft revolution is obtained. A model 16*h* has two pumping modules 28 at an angle of 135° to one another. With a camshaft with four cams, the result is four times the pumping volume, compared to model 16*c*. However, the pumping modules 28 may also be used with a drive region 30, which leads to an in-line arrangement of the pumping modules 28, as in models 16*i* through 16*l*. Depending on the number of cams provided on the camshaft per pumping module 28, different pumping volumes result.

One possible embodiment of a pumping module will now be described in further detail in conjunction with FIGS. 3 and 4:

The pumping module 28 includes a cylinder head 32 with a pressure damper 34 mounted on it. A cylinder bush 36 is retained in the cylinder head 32, and a piston 38 which defines a pumping chamber 39 is guided slidingly in the cylinder bush. A cup-shaped mounting part 40 is also secured to the cylinder head 32 and carries a piston seal 42. A spring plate 44 is secured to the lower end, in terms of FIGS. 3 and 4, of the piston 38. A piston spring 46 is braced between the spring plate and the mounting part 40. In the upper region of the piston 38, in terms of FIGS. 3 and 4, there is a circumferential groove with a securing ring 48, which prevents the piston 38 from being pulled out of the cylinder bush 36 by the piston spring 46 as long as the pumping module 28 is initially not mounted on a drive region 30.

A securing flange 50 is mounted on the cylinder head 32, and with it the pumping module 28 can be secured to a drive region 30. As can be seen from FIG. 3, a low-pressure connection 52 and a high-pressure connection 54 are also present on the pumping module 28. The low-pressure connection 52 communicates with the connection of the prefeed pump 14 (FIG. 1), while the high-pressure connection 54 conversely communicates with the rail 18. From the low-pressure connection 52, a connection leads via the pressure damper 34 to an inlet valve, which borders on the pumping chamber 39 but is not visible in FIGS. 3 and 4. An outlet valve, also not visible in FIGS. 3 and 4, is also located between the high-pressure connection 54 and the pumping chamber 39. The electromagnetic quantity control valve 26 is also inserted into an opening in the cylinder head 32 and has a plug 56 that serves to connect appropriate control lines. The quantity control valve 26 is located coaxially to the inlet valve and actuates it directly (in this sense, the quantity control valve can also be called "electromagnetic compulsory actuation" of the inlet valve).

Figure 3:
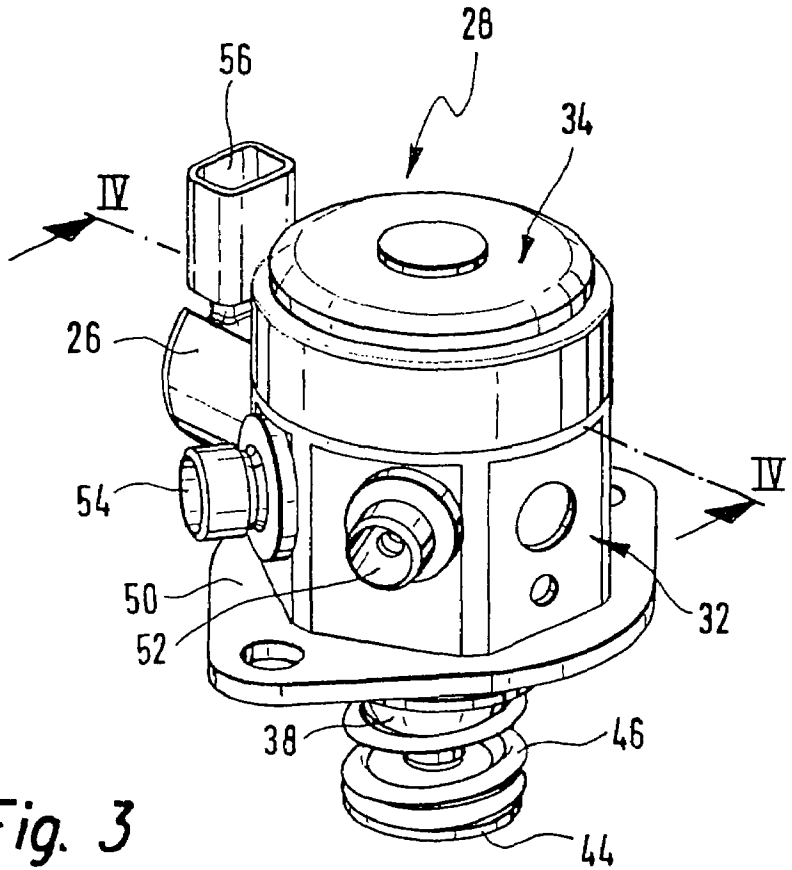
FIG. 3 is a perspective view of the pumping module of FIG. 2.

As can be seen particularly from FIG. 3, the cylinder head 32 is embodied hexagonally. To make it possible to assure the greatest possible variability, the inlet valve and the quantity control valve 26 on the one hand and the outlet valve and the high-pressure connection 54 on the other can each form a respective "sub-module", and these modules are inserted into corresponding openings in the cylinder head 32. Corresponding blind openings may be present in the respective surface portions of the hexagonal cylinder head 32.

It can be seen that the pumping module 28 forms a self-contained unit which can be used with different drive regions or drive modules 30. In the installed state, the piston 38 is set into a reciprocating motion by a camshaft 58, which is part of the drive region 30 and is suggested by dot-dashed lines in FIG. 4.

Figure 6:
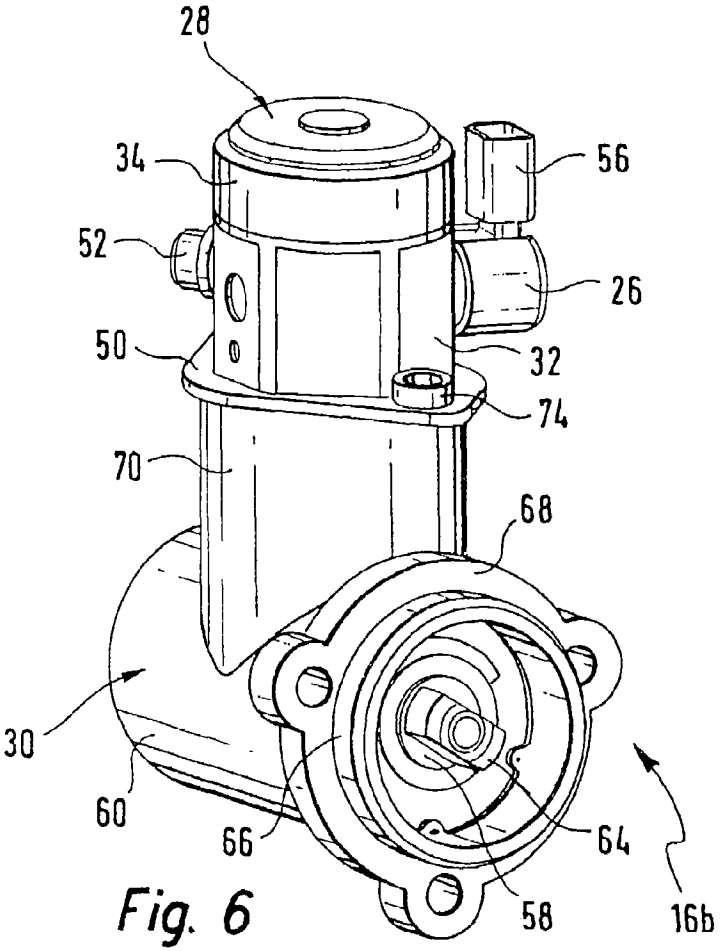
FIG. 6, a perspective front view of the piston pump of FIG. 5.
Figure 5:
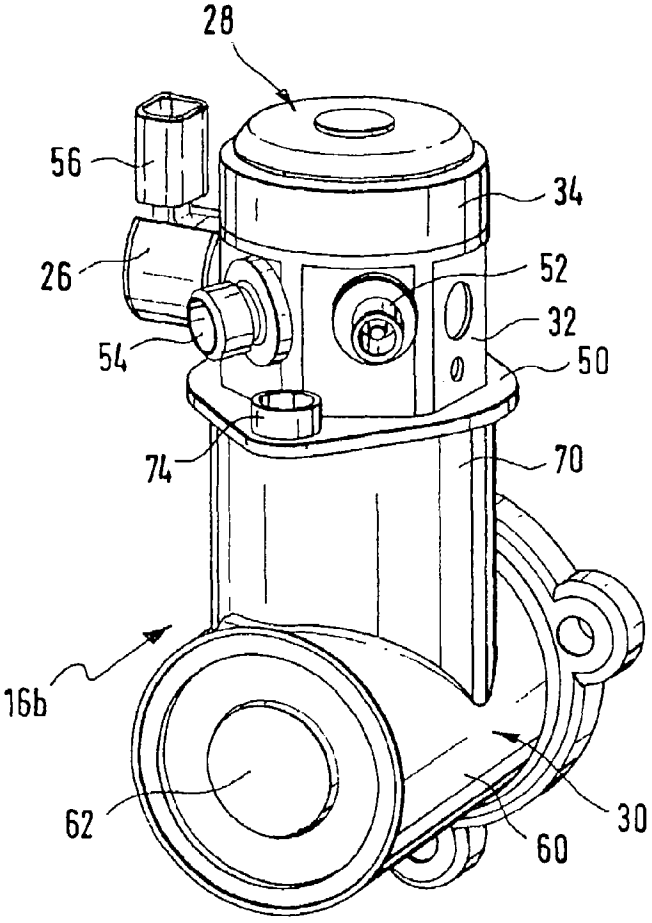
FIG. 5, a perspective view from behind of a first model of a high-pressure piston pump of the set of piston pumps of FIG. 2.

FIGS. 5 and 6 show the use of the pumping module 28 in a one-cylinder pump of the type of model 16*b* in FIG. 2. The corresponding drive region 30 includes a cylindrical housing 60, in which the camshaft 58 is supported. On one end, the housing 60 is closed by an end plate 62 (FIG. 5), while on the other end (FIG. 6) the housing 60 is conversely open, so that the camshaft 58 can be coupled, via an Oldham coupling 64, to a corresponding counterpart coupling (not shown) of the engine 10. On its open end, the housing 60 has a collar 66 extending all the way around and radially outward. Behind it, a flange 68, secured to the housing 60 for instance by welding, is slipped on and can be secured to the engine block 24 of the engine 10. In the same housing 60, the flange 68 can differ from one engine to another, to meet individual securing requirements.

In FIG. 6, the flange 68 is separate from the housing 60. However, if a one-piece housing 60 is preferred, then for instance by means of a two-part construction of a forging or injection-molding tool with which the housing 60 is produced, a different flange geometry can be realized for the same housing shape. For that purpose, the part of the tool with which the housing 60 is molded remains the same, while conversely the part of the tool with which the flange 68 is molded is varied.

A tubular connection neck 70 is formed integrally onto the housing 60, perpendicularly to its longitudinal axis. The pumping module 28 can be inserted into this connection neck. The sealing between the pumping module 28 and the connection neck 70 is accomplished by an O-ring seal 72 (FIG. 4). The pumping module 28 is secured to the connection neck 70 via two screws 74, whose heads (not identified by reference numerals) are braced on the securing flange 50 of the pumping module 28. Corresponding threaded bores are distributed over the circumference in the connection neck 70, so that the pumping module 28 can be secured in the connection neck 70 at different angular positions. In the event of a repair or a defect, all that has to be done is to loosen the two screws 74 and replace the pumping module 28 with a new pumping module.

Figure 7:
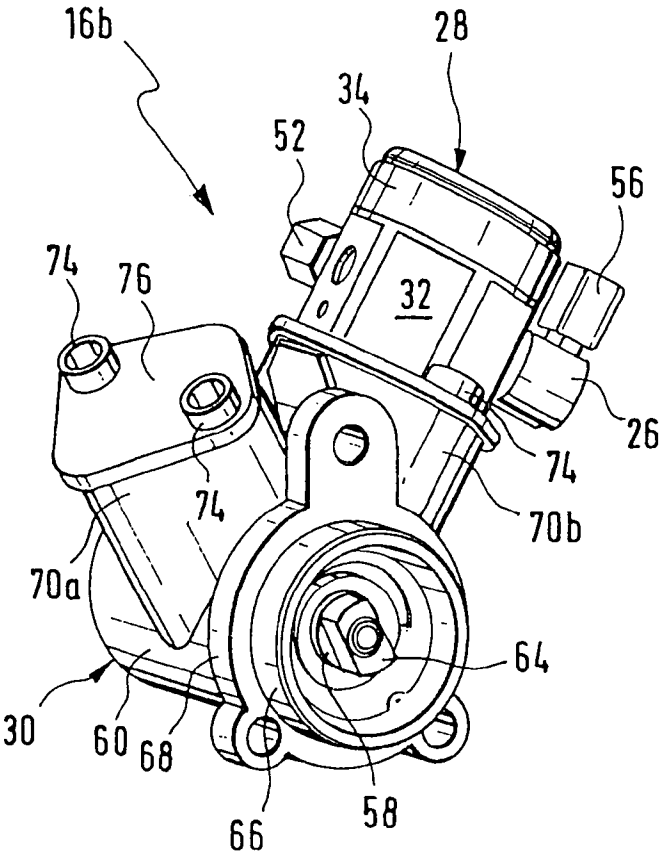
FIG. 7, a perspective view from behind of a second model of a high-pressure piston pump of the set of piston pumps of FIG. 2.

A further model of a one-cylinder pump in accordance with 16*b* of FIG. 2 is shown in FIG. 7. Here and below, those elements and regions that have equivalent functions to elements and regions that have already been named in conjunction with previous drawings are identified by the same reference numerals. They are not explained again in detail.

The drive region 30 shown in FIG. 7 has two connection necks 70*a* and 70*b*, which are located at an angle of 60° to one another. However, a pumping module 28 is inserted only into the connection neck having reference numeral 70*b*. The other connection neck 70*a* is closed by a cover plate 76.

Instead of the cover plate 76, if the housing 60 is an injection-molded part, the second connection neck 70*a* can be omitted completely by means of a suitable embodiment of the injection-molding tool, by placing a core at the appropriate point and removing it as applicable. This has the advantage that for producing a housing 60 with one or more connection necks 70, still only a single tool is needed.

Figure 8:
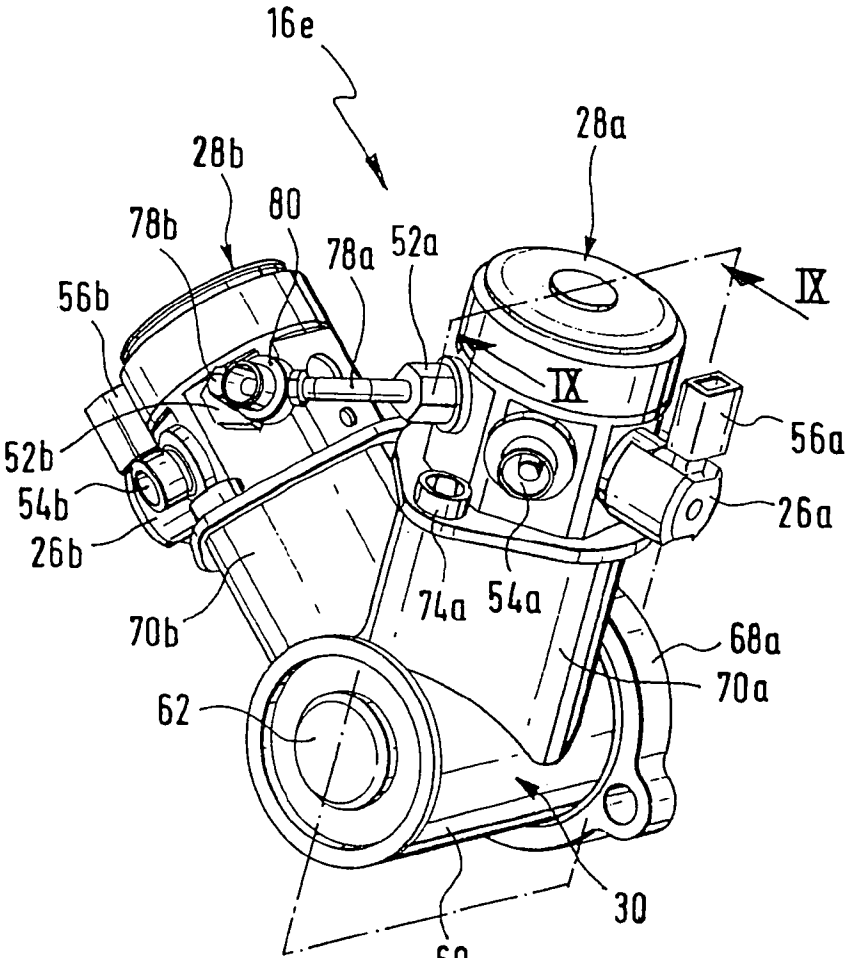
FIG. 8, a perspective front view of a third model of a high-pressure piston pump of the set of piston pumps of FIG. 2.

The same drive region 30 is also used in the model shown in FIG. 8, which results in a high-pressure piston pump in accordance with reference numeral 16*e* in FIG. 2. In the high-pressure piston pump 16*e* shown in FIG. 8, the cover plate 76 has been removed, and there is one pumping module 28*a* in the connection neck 70*a* and one pumping module 28*b* in the connection neck 70*b*. The pumping modules 28*a* and 28*b* are embodied as mirror-reversed to one another. The two low-pressure connections 52*a* and 52*b* communicate with one another via external fuel lines 78*a* and 78*b* and a T-shaped fitting 80. In this way, a common connection of the high-pressure piston pump 16*e* with the prefeed pump 14 (FIG. 1) is created. The same is true for the high-pressure connections 54*a* and 54*b*; the corresponding fuel lines are not shown in FIG. 8 for the sake of simplicity.

Figure 9:
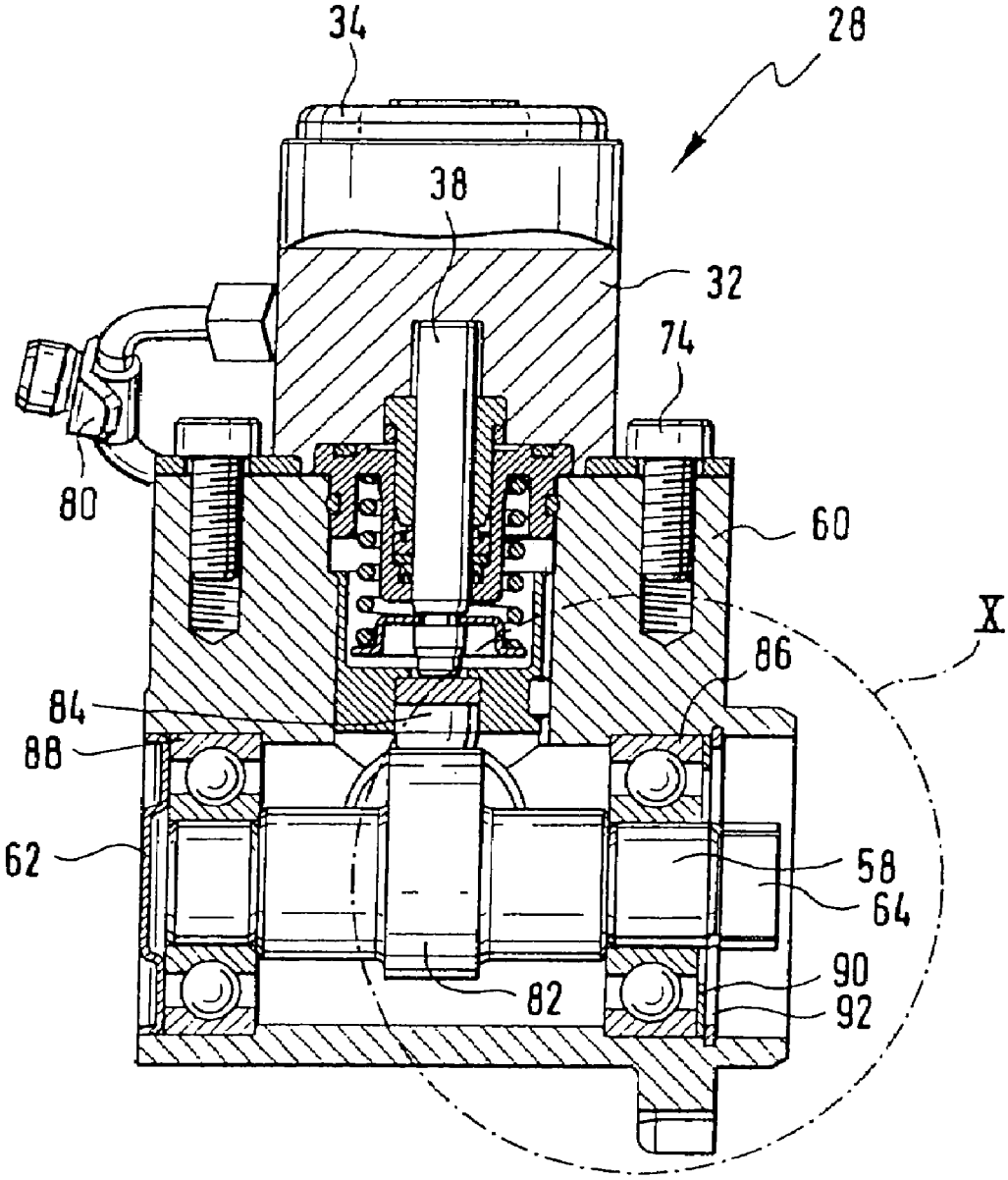
FIG. 9, a fragmentary section in the plane IX-IX of FIG. 8.

FIG. 9 shows the high-pressure piston pump 16*e* of FIG. 8 in a fragmentary section that passes through the pumping module 28*a* and the connection neck 70*a*. For the sake of simplicity, not all the reference numerals are shown. The camshaft 58 can be seen, which has a cam portion 82. Between the cam portion 82 and the piston 38, there is a roller tappet 84, which assures low-friction cooperation of the piston 38 and the cam portion 82. The camshaft 58 is supported on its ends in the housing 60 of the drive region 30 by two bearings 86 and 88. The sealing off of the housing 60 of the drive region 30 from the outside is effected by a sealing ring 90, which is clamped between the bearing 86 and a securing ring 92.

Figure 10:
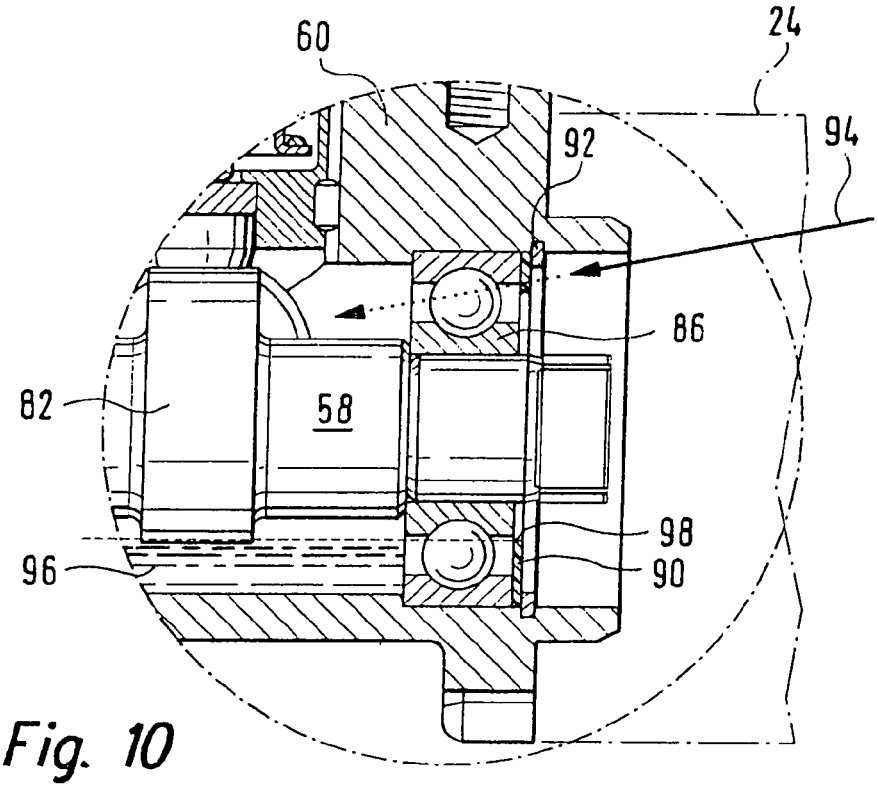
FIG. 10, a detail X of the high-pressure piston pump of FIG. 9.

As indicated in FIG. 10 by an arrow 94, in operation lubricant is injected, from the engine block 24 to which the housing 60 of the drive region 30 is flanged, through the bearing 86 into the interior of the housing 60. In this way, the components of the high-pressure piston pump 16*e* that move relative to one another are lubricated. An essential feature is that on the bottom of the housing 60, a lubricant sump 96 forms, which is high enough that the cam portion 82 of the camshaft 58 can plunge into this lubricant sump 96 and be wetted by lubricant. By the plunging cam portion 82, the lubricant in the housing 60 is made turbulent, as a result of which a supply of lubricant to the roller tappet 84 (mist lubrication) is for instance also effected.

Figure 11:
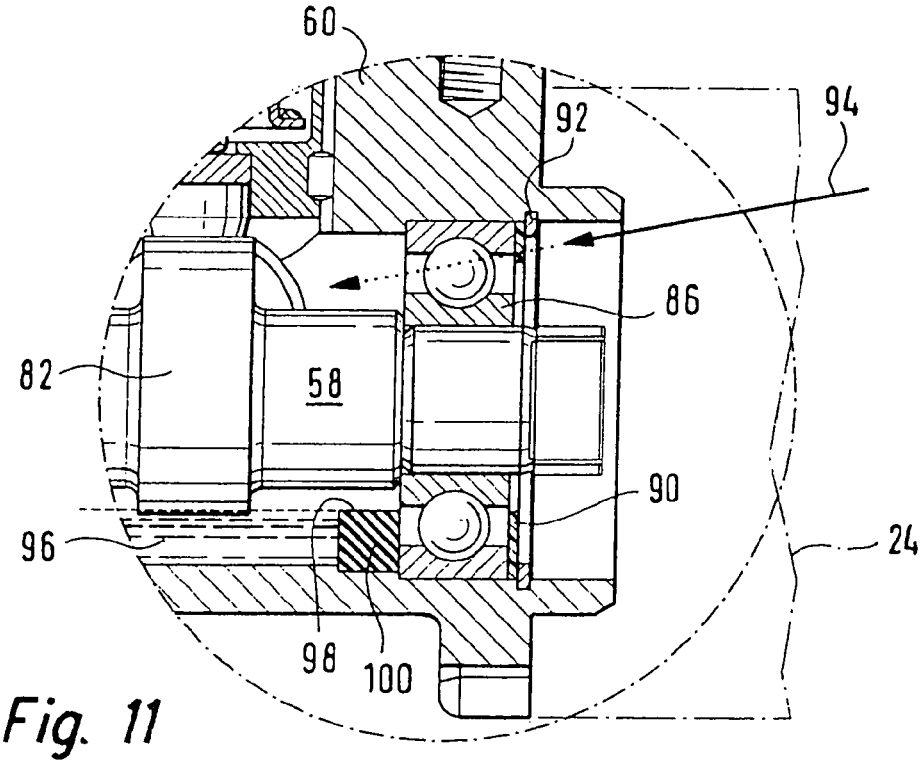
FIG. 11, a view similar to FIG. 10 of a modified embodiment of a high-pressure piston pump.

The height of the lubricant sump 96 in the housing 60 is determined, as FIG. 10 shows, by the location of an overflow edge 98 on the sealing ring 90. As can be seen from FIG. 11, alternatively in the interior of the housing 60 there may be an inlay part 100 that has the corresponding overflow edge 98.

Figure 4:
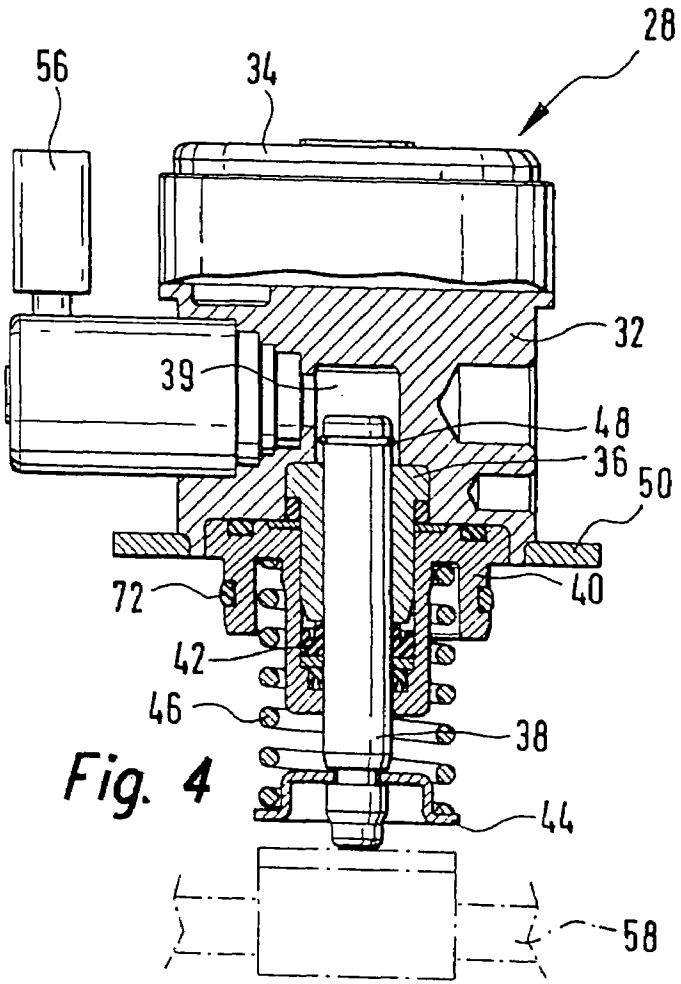
FIG. 4 is a fragmentary section through the plane IV-IV of FIG. 3.
Figure 12:
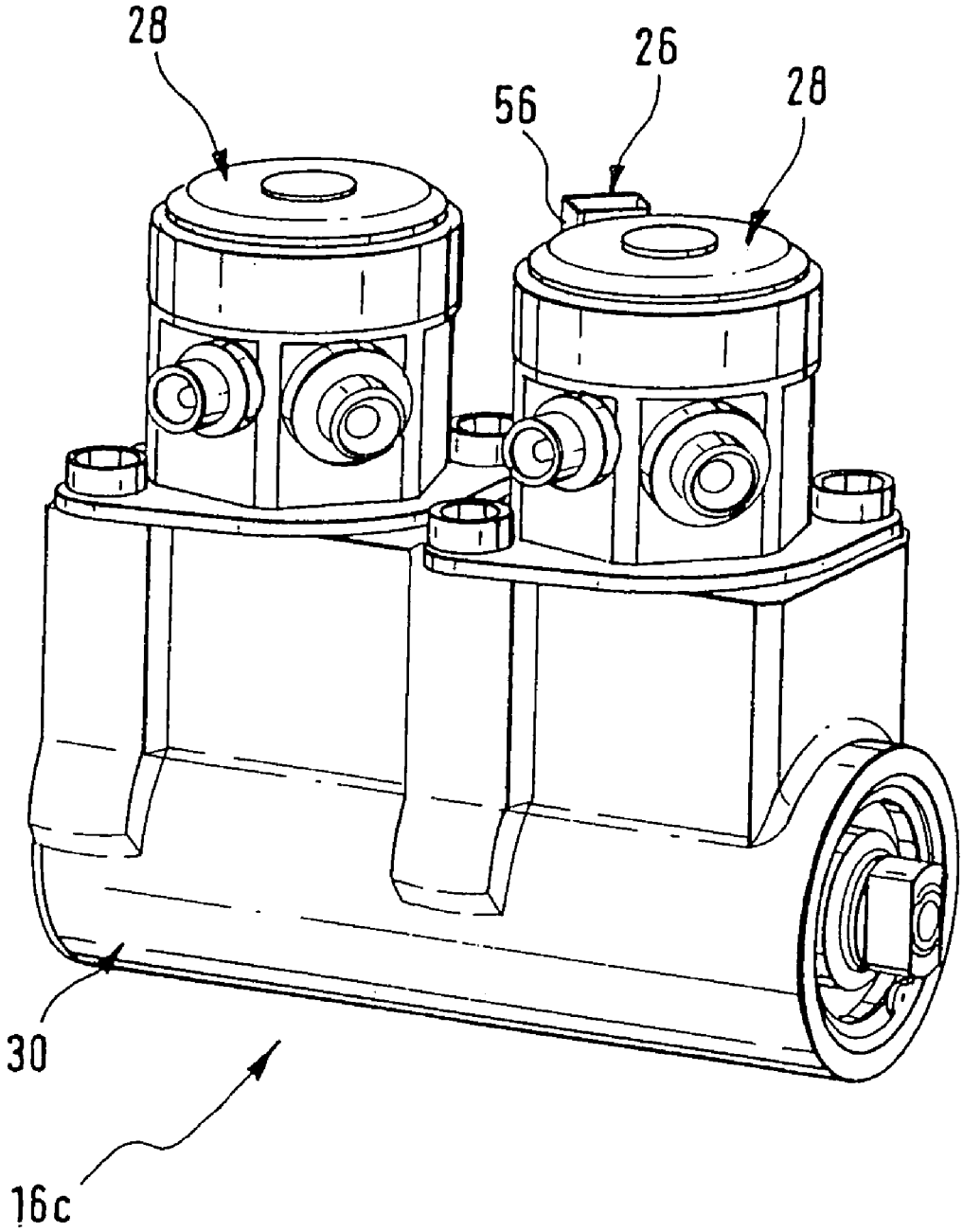
FIG. 12, a perspective view of a fourth model of a high-pressure piston pump from the set of piston pumps of FIG. 2.

A further model corresponding to reference numeral 16*i* in FIG. 2 is shown in FIG. 12; once again, structurally identical pumping modules 28 as in FIGS. 3 and 4 are used. For the sake of simplicity, only the fundamental reference numerals are shown in FIG. 12.

In the case of the high-pressure piston pump 16*e* shown in FIG. 8, there was one quantity control valve 26 for each of the two pumping modules 28. Conversely, the high-pressure piston pump 16*i* shown in FIG. 12 has a quantity control valve 26 on only one pumping module 28. The corresponding opening in the other pumping module 28 is closed with a blind stopper (not visible). This last-mentioned pumping module 28 thus pumps continuously during operation of the high-pressure piston pump 16*i*, while with the other pumping module 28, the pumping quantity can be adjusted by means of the quantity control valve 26.

The mode of operation of the high-pressure piston pumps 16 described is the same in each case: If the camshaft 58 is set into rotation, the piston 38 of a pumping module 28 is forced into an axial reciprocation by the cam portion 82. This leads to cyclical changes in volume of the pumping chamber 39. If the volume of the pumping chamber 39 increases, fuel is aspirated into the pumping chamber 39 from the low-pressure connection 52. If the volume of the pumping chamber 39 decreases, the fuel enclosed in the pumping chamber 39 is compressed, as a function of the position of the quantity control valve 26, and expelled via the high-pressure connection 54 to the rail 18. It can be seen that the compression and pumping of the fuel are effected solely in the pumping module 28, while conversely the modular drive region 30 does not come into contact with fuel that is at high pressure. The housing 60 of the drive region 30 is therefore made of lightweight metal, such as aluminum, in all the high-pressure fuel pumps 16 shown above. The wall thicknesses of the housing 60 are moreover comparatively slight.

The foregoing relates to preferred exemplary embodiments of the invention, it being understood that other variants and embodiments thereof are possible within the spirit and scope of the invention, the latter being defined by the appended claims.

The invention claimed is:

1. In a set of piston pumps, in particular fuel pumps for internal combustion engines with direct fuel injection, each having one drive region and at least one pumping region, the improvement wherein the set of piston pumps comprises at least two piston pumps having different design, and the pumping regions of all the piston pumps of the set are embodied as structurally identical pumping modules, wherein the models in a set differ in the arrangement and/or number of the pumping modules.

2. The set of piston pumps according to claim 1, wherein the set of piston pumps includes identical structurally identical pumping modules and/or pumping modules that are mirror-reversed structurally identical to one another with respect to a longitudinal axis.

3. The set of piston pumps according to claim 1, wherein the drive regions of the piston pumps of a set are embodied as structurally identical drive modules each having a plurality of connection points for pumping modules, and wherein the set includes at least one piston pump whose drive module has a connection point at which there is no pumping module and which is instead closed by a closure element.

4. The set of piston pumps according to claim 3, wherein the drive modules have a uniform connection to different securing devices, with which the piston pump can be fixed.

5. The set of piston pumps according to claim 1, further comprising at least one piston pump having a pumping module which is inserted into the drive region.

6. The set of piston pumps according to claim 2, further comprising at least one piston pump having a pumping module which is inserted into the drive region.

7. The set of piston pumps according to claim 3, further comprising at least one piston pump having a pumping module which is inserted into the drive region.

8. The set of piston pumps according to claim 1, further comprising at least one piston pump whose drive region is integrated with an internal combustion engine.

9. The set of piston pumps according to claim 1, further comprising includes at least one piston pump, whose drive region is separate from the engine.

10. The set of piston pumps according to claim 2, further comprising includes at least one piston pump, whose drive region is separate from the engine.

11. The set of piston pumps according to claim 4, further comprising includes at least one piston pump, whose drive region is separate from the engine.

12. The set of piston pumps according to claim 1, further comprising at least one piston pump, in which all the fluid connections are located outside the at least one pumping module.

13. The set of piston pumps according to claim 1, further comprising at least one piston pump, whose drive region is coupled to a drive mechanism by means of a coupling device, and a device in the region of the drive mechanism with which lubricant is injected into the drive region.

14. The set of piston pumps according to claim 1, further comprising at least one piston pump having an overflow edge, by means of which the maximum height of a lubricant sump in the drive region is defined.

15. The set of piston pumps according to claim 1, further comprising at least one piston pump, whose drive region has a housing of lightweight metal.

16. The set of piston pumps according to claim 1, further comprising at least one piston pump, whose housing is produced as a forged or injection-molded part.

17. A piston pump, in particular a fuel pump for internal combustion engines with direct fuel injection, having one drive region and at least one pumping region, it is part of a set of piston pumps as recited in claim 1.

* * * * *